US012465187B2

(12) United States Patent
Chan et al.

(10) Patent No.: US 12,465,187 B2
(45) Date of Patent: Nov. 11, 2025

(54) SURFACE CLEANER

(71) Applicant: Techtronic Cordless GP, Anderson, SC (US)

(72) Inventors: Somnanritha Chan, Matthews, NC (US); Rafael Davila, Kannapolis, NC (US); Michael Dawson, Huntersville, NC (US); Jeremy Hansen, Huntersville, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 297 days.

(21) Appl. No.: 18/255,319

(22) PCT Filed: Nov. 30, 2021

(86) PCT No.: PCT/US2021/061151

§ 371 (c)(1),
(2) Date: May 31, 2023

(87) PCT Pub. No.: WO2022/119817

PCT Pub. Date: Jun. 9, 2022

(65) Prior Publication Data

US 2024/0016360 A1 Jan. 18, 2024

Related U.S. Application Data

(60) Provisional application No. 63/120,003, filed on Dec. 1, 2020.

(51) Int. Cl.

| | |
|---|---|
| ***A47L 11/40*** | (2006.01) |
| ***A47L 11/30*** | (2006.01) |
| ***A47L 11/34*** | (2006.01) |

(52) U.S. Cl.
CPC ..... *A47L 11/4083* (2013.01); *A47L 11/30* (2013.01); *A47L 11/34* (2013.01); *A47L 11/4016* (2013.01); *A47L 11/4075* (2013.01)

(58) Field of Classification Search
CPC ..... A47L 11/4083; A47L 11/34
See application file for complete search history.

(56) References Cited

U.S. PATENT DOCUMENTS

| | | | | |
|---|---|---|---|---|
| 4,724,573 | A * | 2/1988 | Ostergaard | A47L 11/40 15/353 |
| 5,237,720 | A * | 8/1993 | Blase | A47L 11/4044 15/321 |
| 5,301,386 | A * | 4/1994 | Thomas | A47L 11/34 15/353 |

(Continued)

FOREIGN PATENT DOCUMENTS

| | | |
|---|---|---|
| EP | 0545138 A1 | 6/1993 |
| EP | 2742842 A1 | 6/2014 |

OTHER PUBLICATIONS

International Search Report and Written Opinion for Application No. PCT/US2021/061151 dated Mar. 16, 2022 (15 pages).

(Continued)

*Primary Examiner* — Bryan R Muller
(74) *Attorney, Agent, or Firm* — Michael Best & Friedrich LLP

(57) ABSTRACT

A surface cleaner configured to distribute a liquid to a surface to be cleaned. The surface cleaner includes a supply tank and a recovery tank that are removable from the surface cleaner.

15 Claims, 7 Drawing Sheets

(56) References Cited

U.S. PATENT DOCUMENTS

| | | | | |
|---|---|---|---|---|
| 5,836,046 | A * | 11/1998 | Huffman | A47L 11/4013 15/327.5 |
| 7,073,226 | B1 * | 7/2006 | Lenkiewicz | A47L 11/4083 15/327.2 |
| 7,228,589 | B2 * | 6/2007 | Miner | A47L 11/34 15/385 |
| 8,117,713 | B2 * | 2/2012 | Kasper | A47L 9/0027 15/328 |
| 8,549,697 | B1 * | 10/2013 | Moyher, Jr. | A47L 11/405 15/319 |
| 9,107,558 | B2 * | 8/2015 | Lenkiewicz | A47L 11/4016 |
| 9,532,693 | B1 * | 1/2017 | Tran | A47L 11/305 |
| 10,674,881 | B2 * | 6/2020 | Chavana, Jr. | A47L 5/365 |
| 10,986,975 | B2 * | 4/2021 | Rukavina | A47L 11/4077 |
| 11,259,679 | B2 * | 3/2022 | Royale | A47L 7/0009 |
| 11,559,039 | B2 * | 1/2023 | Hoffmann | A47L 7/0009 |
| D995,960 | S * | 8/2023 | Liu | D32/21 |
| 12,239,266 | B2 * | 3/2025 | Wright | A47L 11/4016 |
| 2013/0318741 | A1 * | 12/2013 | Moyher, Jr. | A47L 11/4083 15/327.1 |
| 2015/0135473 | A1 * | 5/2015 | Simon | A47L 11/34 15/320 |
| 2017/0127900 | A1 | 5/2017 | Wright et al. | |
| 2018/0103611 | A1 * | 4/2018 | Mainini | A47L 9/2842 |
| 2020/0093343 | A1 | 3/2020 | Quintero et al. | |

OTHER PUBLICATIONS

Vietnamese Patent Office Action for Application No. 1-2023-03983 dated Feb. 28, 2025 (3 pages including English translation).

Australian Patent Office Action for Application No. 2021391424 dated May 20, 2024 (4 pages).

* cited by examiner

SURFACE CLEANER

CROSS-REFERENCE TO RELATED APPLICATIONS

This application claims priority to U.S. Provisional Patent Application No. 63/120,003, filed Dec. 1, 2020, the entire contents of which are hereby incorporated by reference herein.

BACKGROUND

The present invention relates to surface cleaners, and more particularly, a tank arrangement in a wet surface cleaner.

SUMMARY

In one embodiment a surface cleaner is disclosed including a main body, a supply tank, and a recovery tank. The main body has a base that supports the surface cleaner on a surface and a center column extending upwardly from the base. The supply tank and the recovery tank are removably coupled to and supported by the base. One or both of the supply tank and the recovery tank are substantially U-shaped around the main body and encompass the center column, such that the supply tank and the recovery tank form an outer wall of an upper end of the surface cleaner, the upper end opposite the base, wherein the supply tank and the recovery tank form at least 85% of a perimeter of the upper end.

In one embodiment a surface cleaner is disclosed including a base that supports the cleaner on a surface, outwardly facing side surfaces around a perimeter of the surface cleaner, a supply tank, and a recovery tank. The supply tank is removably coupled to and supported by the base, the supply tank having upwardly extending supply tank walls disposed along the perimeter, the upwardly extending supply tank walls forming a portion of the outwardly facing side surfaces. The recovery tank is removably coupled to and supported by the base, the recovery tank having upwardly extending recovery tank walls disposed along the perimeter, the upwardly extending recovery tank walls forming a portion of the outwardly facing side surfaces. The upwardly extending supply tank walls and upwardly extending recovery tank walls together form at least 85% of the perimeter of the outwardly facing side surfaces of the cleaner.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced

DETAILED DESCRIPTION

The present disclosure relates to a surface cleaner, specifically a wet surface cleaner with a supply tank and a recovery tank that are removable from the cleaner. When the supply tank and the recovery tank are attached to the cleaner, the tanks form an outer wall of an upper end of the surface cleaner forming a large portion of the perimeter of the upper end. This tank arrangement promotes even weight distribution, increases tank capacity without increasing cleaner size, and allows identification of tank fullness from various angles, among other benefits.

Figure 1:
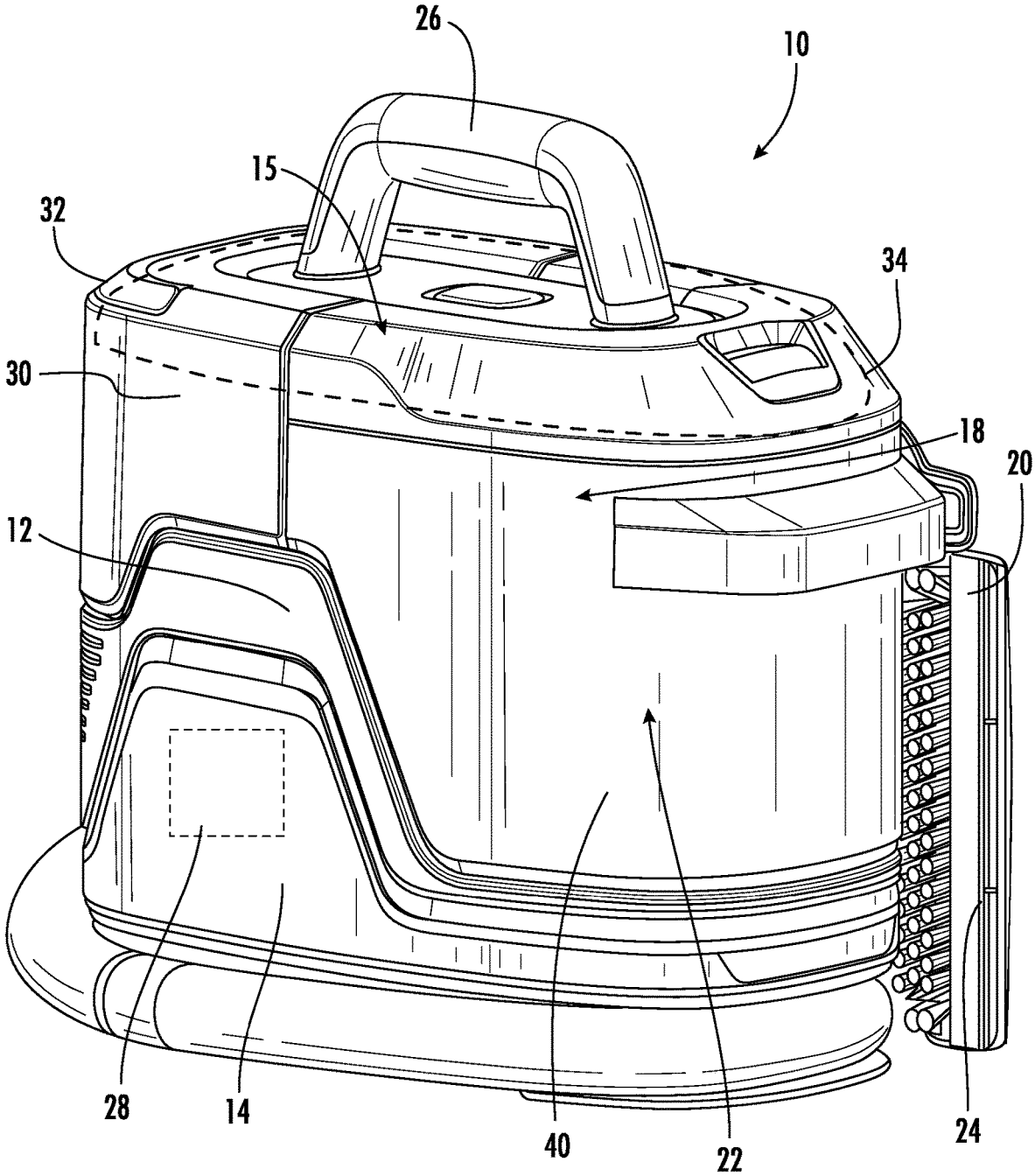
FIG. 1 is a perspective view of a surface cleaner according to one embodiment.

FIG. 1 illustrates a perspective view of a surface cleaner 10 according to an embodiment of the invention. The surface cleaner 10 is a surface cleaner that delivers a liquid, such as a spot cleaner, carpet or hard floor extractor, or the like having adjacent supply and recovery tanks. The surface cleaner 10 has a main body 12 with a base 14 that supports the surface cleaner on a surface to be cleaned. The surface cleaner 10 includes an outer side wall 22 that extends between the base 14 and a top portion 15. The outer side wall 22 includes an upper end 18 adjacent the top portion 15 and opposite the base 14. The main body 12 also includes a center column 16 extending upwardly from the base 14. The surface cleaner includes a supply tank 30 configured to provide a cleaning liquid, a suction inlet 24 (shown in FIG. 1 in a stowed position) in fluid communication with a suction source 28 configured to generate a suction airflow to draw air and debris and/or liquid through the suction inlet 24, and a recovery tank 40 in fluid communication with the suction inlet 24 and suction source 28, the recovery tank 40 configured to contain debris and/or liquid collected through the suction inlet 24.

Figure 2:
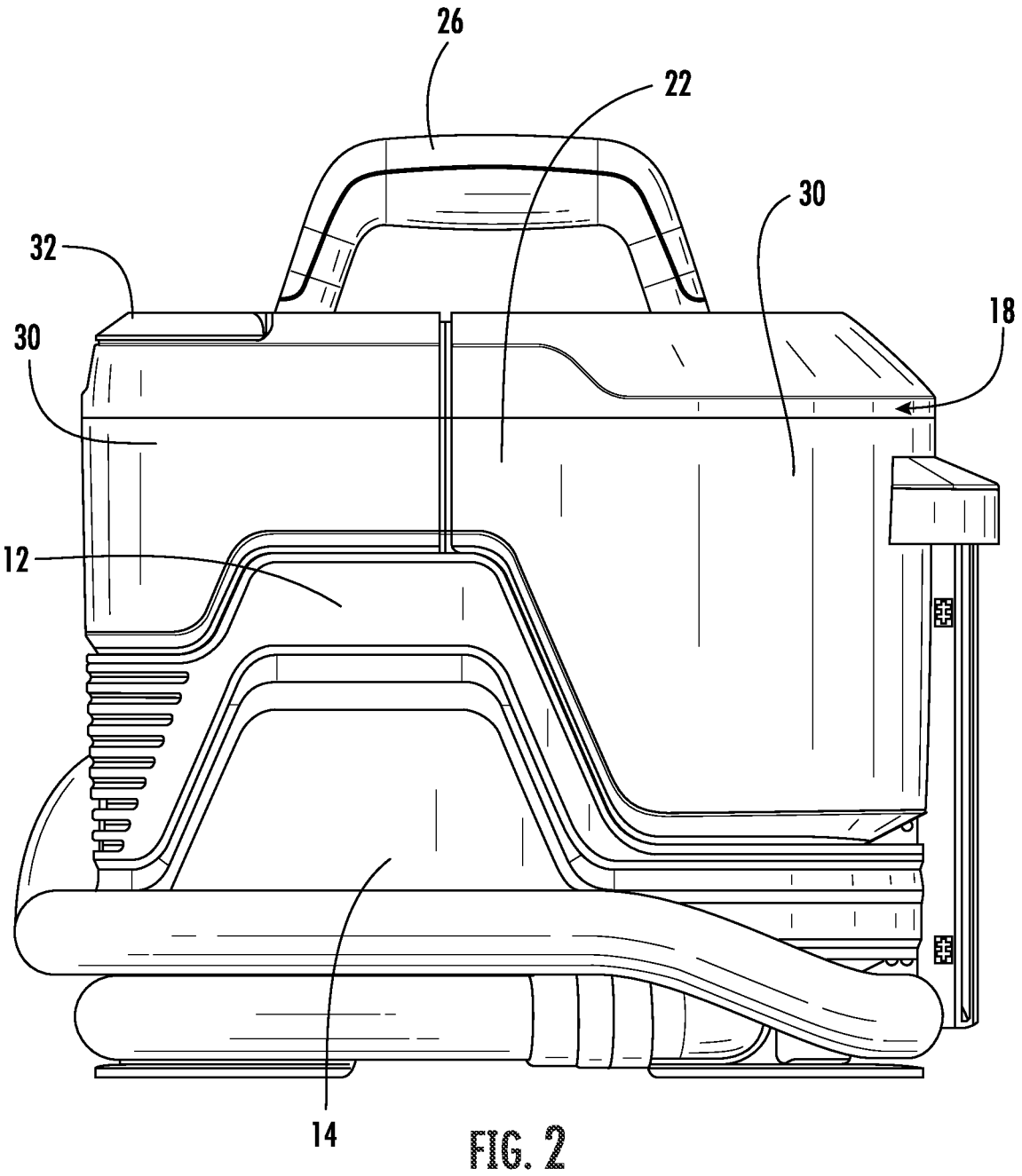
FIG. 2 is a side view of the surface cleaner of FIG. 1.
Figure 3:
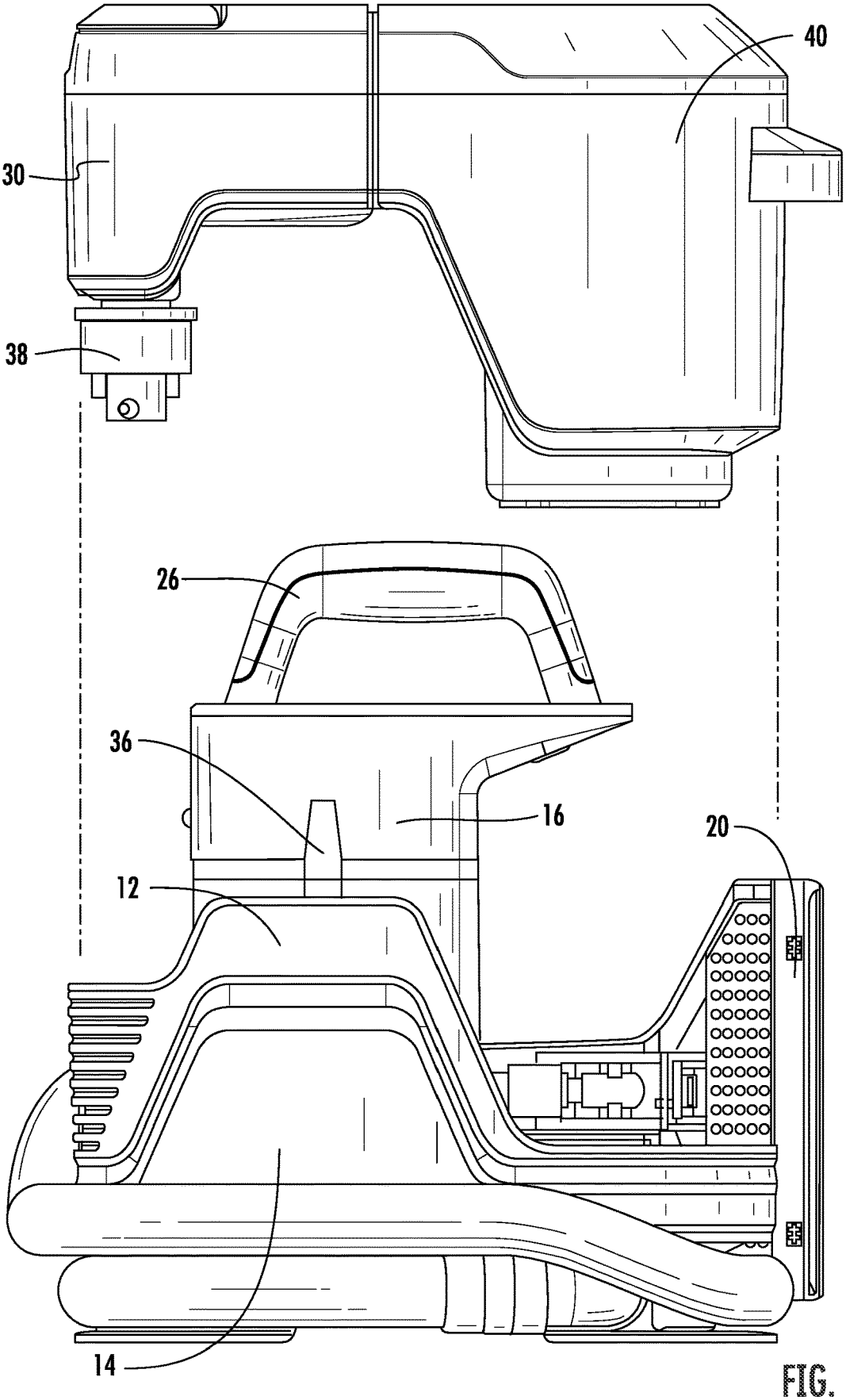
FIG. 3 is an exploded view of the surface cleaner of FIG. 1 showing a supply tank and a recovery tank removed from the surface cleaner, according to one embodiment.
Figure 3A:
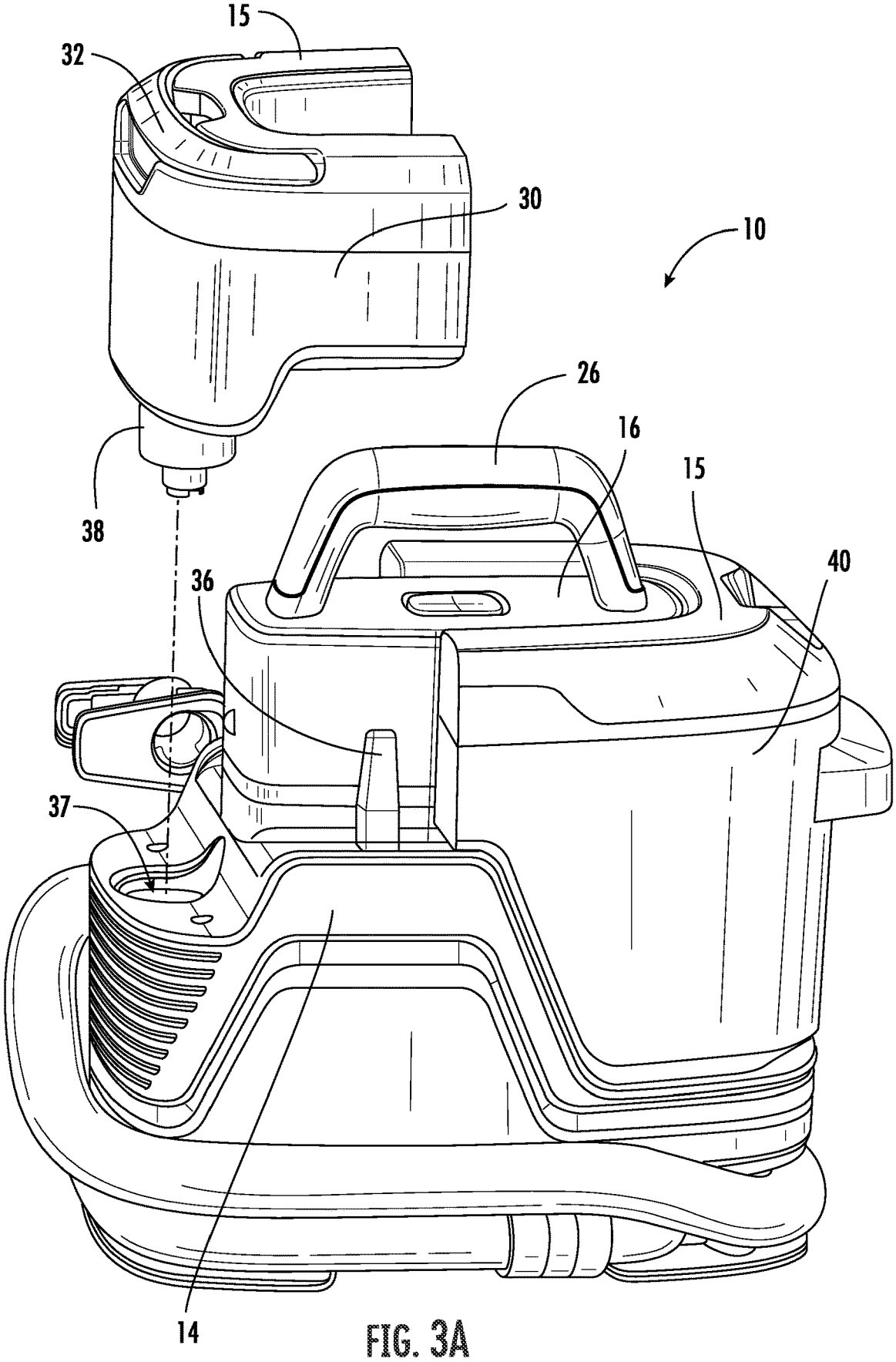
FIG. 3*a* is an exploded view of the surface cleaner of FIG. 1 showing a supply tank removed from the surface cleaner, according to one embodiment.

The supply tank 30 is removable from the surface cleaner 10 to allow filling, cleaning, and maintenance of the supply tank 30. The supply tank 30 is movable between an in use, coupled position in which the supply tank 30 is supported by the base 14 (FIGS. 1-2), and a removed position in which the supply tank 30 is not coupled to the surface cleaner 10 (FIGS. 3 and 3*a*). The recovery tank 40 is removable from the surface cleaner 10 to allow emptying, cleaning, and maintenance of the recovery tank 40. The recovery tank 40 is movable between an in use, coupled position in which the recovery tank 40 is supported by the base 14 (FIGS. 1-2), and a removed position in which the recovery tank 40 is not coupled to the surface cleaner 10 (FIGS. 3 and 3*a*).

In one embodiment, the surface cleaner 10 further includes a cleaning tool 20 (shown in FIG. 1 in a stowed position) attached to the main body 12 or the base 14. The cleaning tool 20 may be an agitating brush, a static brush, a spot cleaning tool, or another type of accessory cleaning tool. In one embodiment, the cleaning tool 20 includes a liquid distributor in fluid communication with the supply tank and configured to distribute liquid to the surface to be cleaned. In one embodiment, the cleaning tool 20 may include the suction inlet 24 in fluid communication with the suction source 28 and the recovery tank 40 to draw air and debris and/or liquid from the surface to be cleaned.

The outer side wall 22 forms outwardly facing side surfaces around a perimeter 34 of the surface cleaner 10. In one embodiment, the supply tank 30 and the recovery tank 40 include upwardly extending tank walls that form at least a portion of the outer side wall 22. In the illustrated embodiment, the supply tank 30 and the recovery tank 40 surround the center column 16 and form the outer side wall 22 of the surface cleaner 10. In one embodiment, the supply tank 30 and the recovery tank 40 form at least 75% of the perimeter 34 of the upper end 18. In another embodiment, the supply tank 30 and the recovery tank 40 form at least 85% of a perimeter 34 of the upper end 18. In the illustrated embodiment, the outer side wall 22 formed by the tanks is substantially continuous around the surface cleaner 10, specifically the upper end 18 of the outer wall 22 is continuous around the surface cleaner 10. In one embodiment, the supply tank 30 and the recovery tank 40 are substantially U-shaped around the main body 12 and encompass the center column 16. In this embodiment, the top portion 15 may be U-shaped or may be another shape, such as rectangular. In one embodiment, one of the supply tank 30 and the recovery tank 40 is substantially U-shaped around the main body 12 and encompasses the center column 16, while the other of the supply tank 30 and the recovery tank 40 is not substantially U-shaped, for one example having generally rectangular or other cross-sectional shape. The generally rectangular or other cross-sectional shaped tank is positioned to meet the ends of the substantially U-shaped tank to form the substantially continuous outer wall 22 of the surface cleaner. In both arrangements, the supply tank 30 and the recovery tank 40 form the outer side wall 22 of the upper end 18 of the surface cleaner.

Having the supply tank 30 and the recovery tank 40 form a substantial portion of the perimeter 34 of the upper end 18 allows the surface cleaner 10 to have increased liquid carrying capacity without increasing the overall size and weight of the surface cleaner 10. By encompassing and surrounding the center column 16, the supply tank 30 and recovery tank 40 promote even weight distribution of liquid in the surface cleaner 10. Improved weight distribution of liquid in the surface cleaner 10 allow the user to more easily move the surface cleaner 10 during and after use. Further, this tank arrangement makes the capacity appear larger to the user while still being perceived as lightweight, compact, and portable.

In one embodiment, the supply tank 30 and the recovery tank 40 are formed from a transparent or translucent material. The transparent or translucent material allows a user to more easily identify the volume in the supply tank 30 or the recovery tank 40 from a variety of viewing angles. The transparent or translucent exterior also provide an appearance of increased volume capacity.

Figure 2A:
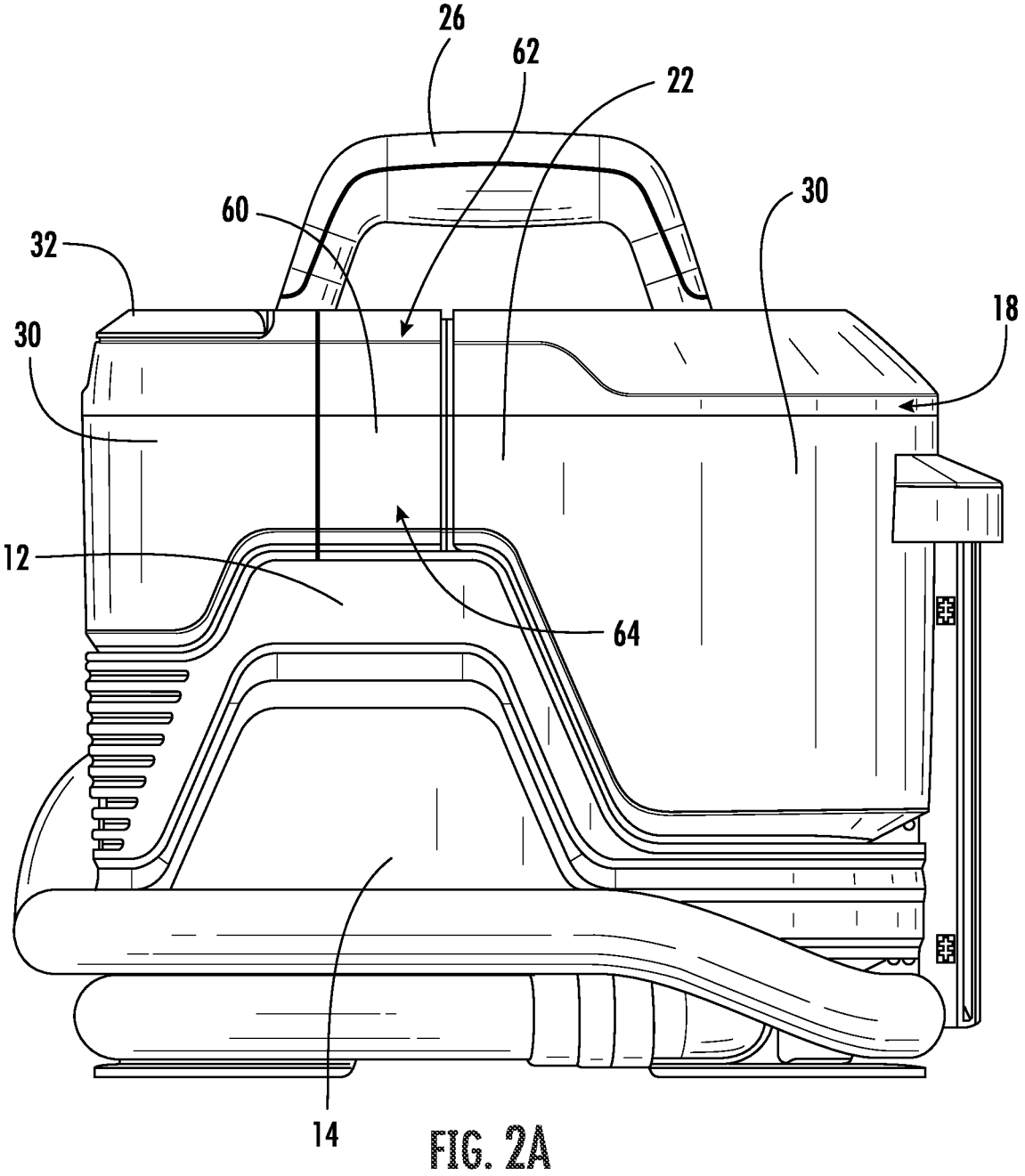
FIG. 2*a* is a side view of another embodiment of the surface cleaner of FIG. 1.

In the embodiment illustrated in FIG. 2*a*, the surface cleaner 10 further includes a detergent tank 60 removably coupled to the surface cleaner 10. The detergent tank 60 includes an upper portion 62 and a lower portion 64. The lower portion 64 is removably coupled to the base 14. The upper portion 62 of the detergent tank 60 makes up a portion of the outer side wall 22 of the surface cleaner 10, along with the supply tank 30 and the recovery tank 40. In one embodiment, the detergent tank 60 is removable with the supply tank 30, however in another embodiment the detergent tank 60 is removable independent of the supply tank 30. The detergent tank 60 allows the user a more customizable cleaning experience to tailor the cleaning solution to their cleaning needs based on surface type and soil level.

In one embodiment, the surface cleaner 10 further comprises a handle 26 that is graspable by the user for moving the surface cleaner. In the illustrated embodiment, the handle 26 is coupled to the center column 16 and extends above the upper end 18 of the supply tank and the upper end 18 of the recovery tank. In the illustrated embodiment, the handle 26 extends between the supply tank 30 and the recovery tank 40.

In the illustrated embodiment, the supply tank 30 includes a tank handle 32 on the upper end 18. The tank handle 32 may be a bail handle. The tank handle 32 allows the user to grasp and remove the supply tank 30 with one hand. In one embodiment, the tank handle 32 is a recess graspable by the user. In one embodiment, the tank handle 32 is integral with the supply tank 30.

Figure 4:
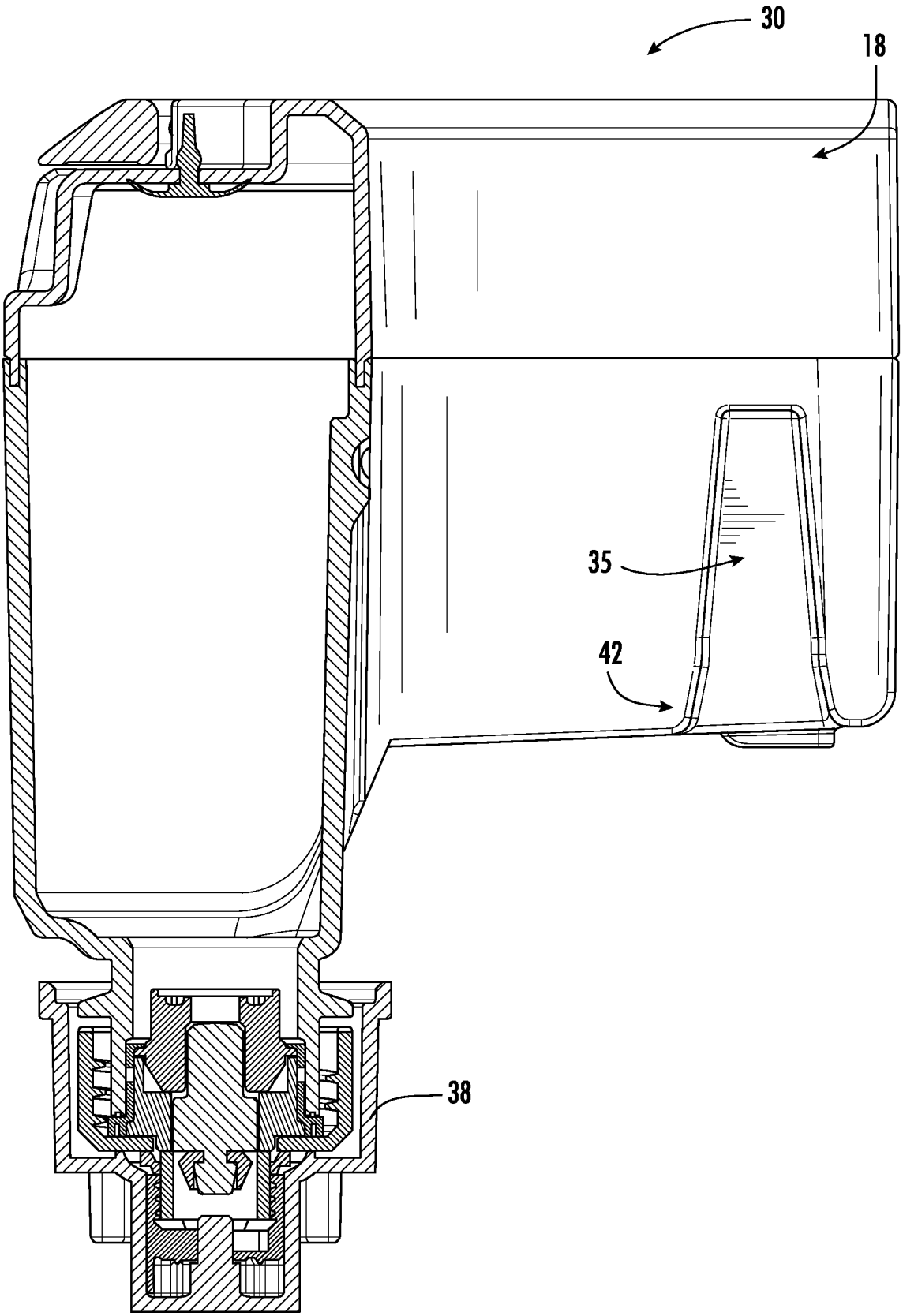
FIG. 4 is a cross-sectional view of the supply tank shown in FIG. 1.
Figure 5:
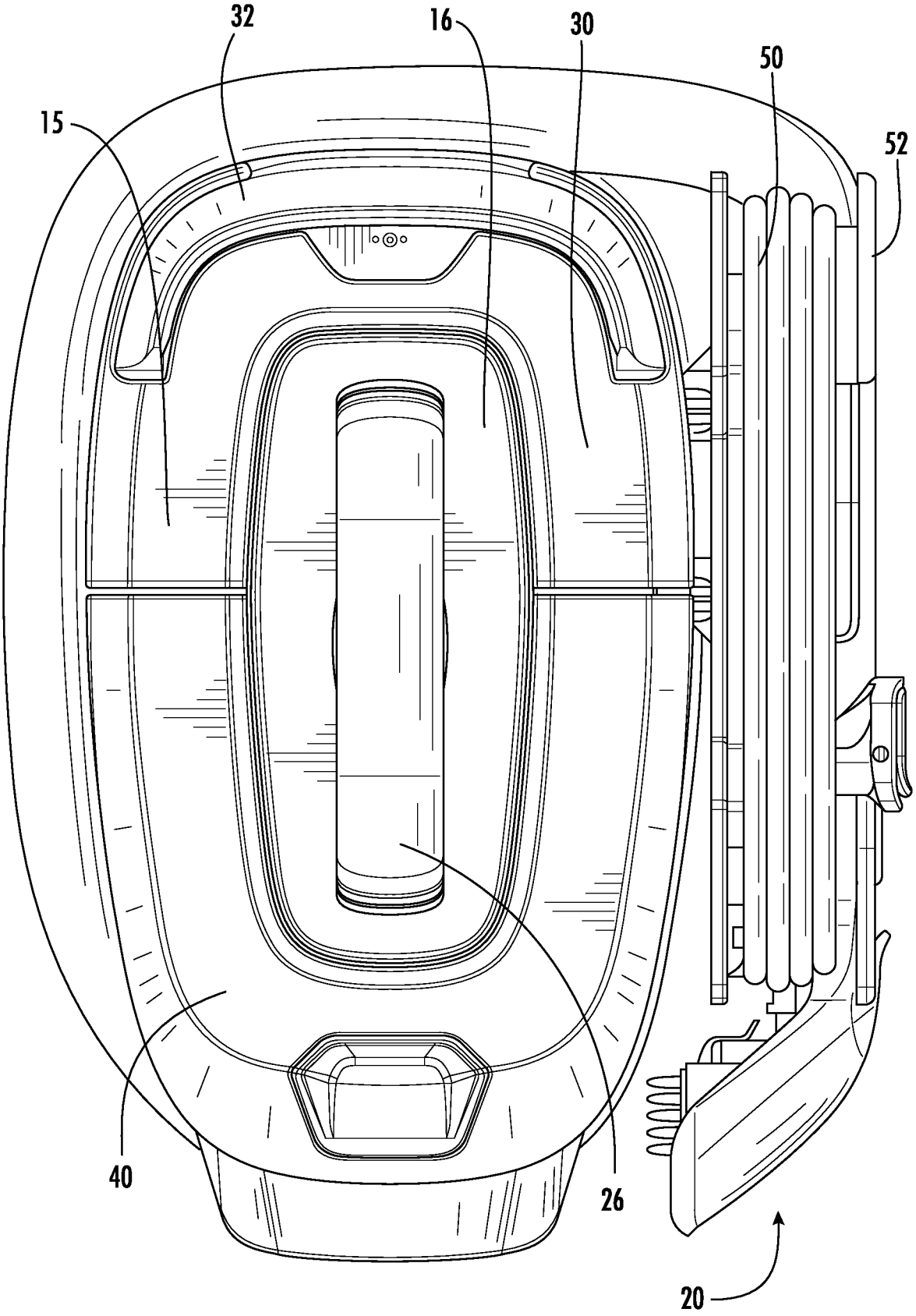
FIG. 5 is a top view of the surface cleaner of FIG. 1.

In the embodiment illustrated in FIGS. 3 and 3*a*, the center column 16 includes a tab or a protrusion 36. The protrusion 36 is positioned to mate with a corresponding groove 35 (shown in FIG. 4) in the supply tank 30. The protrusion 36 and the groove 35 are configured to align the supply tank 30 when the supply tank 30 is being place in the attached position on the surface cleaner 10. The groove 35 in the supply tank 30 extends from a bottom portion 42 and extends toward the upper end 18. The supply tank 30 is installed by aligning the groove 35 with the protrusion 36 and guiding the supply tank 30 downwardly to rest on the base 14. In another embodiment, the center column 16 includes a groove or a track that is configured to align with a protrusion or a tab positioned on the supply tank 30 to promote alignment into the attached position. The supply tank 30 further includes a cap 38 that is configured to mate with a recess 37 in the base 14. The cap 38 and recess 37 arrangement retains the supply tank 30 in the attached position. The groove 35 and protrusion 36 arrangement assist the user in correctly placing the supply tank 30 on the surface cleaner 10, and the cap 38 and recess 37 arrangement retain and secure the supply tank 30 once attached. In one embodiment, the center column 16 further includes a protrusion positioned to mate with a corresponding groove or track in the recovery tank 40 to promote alignment into the attached position.

In the illustrated embodiment, the suction source 28 of the surface cleaner 10 is powered by a power cord 50. The power cord 50 may be stored on a cord wrap assembly coupled to the surface cleaner 10. In another embodiment, the suction source 28 of the surface cleaner 10 is powered by a battery pack.

Various features and advantages of the invention are set forth in the following claims.

What is claimed is:

1. A surface cleaner comprising:

a main body having a base that supports the surface cleaner on a surface and a center column extending upwardly from the base;

a supply tank removably coupled to and supported by the base;

a recovery tank removably coupled to and supported by the base;

wherein one or both of the supply tank and the recovery tank are substantially U-shaped around the main body and encompass the center column, such that the supply tank and the recovery tank form an outer side wall of the surface cleaner, the outer side wall having an upper end that extends to a top portion of the surface cleaner, the upper end opposite the base, wherein the upper end of the outer side wall, defined only by the supply tank and recovery tank, extends around the entire perimeter of the surface cleaner with the center column extending upwards into a space between the supply tank and the recovery tank.

2. The surface cleaner according to claim 1, wherein the supply tank and the recovery tank are formed from a transparent or translucent material.

3. The surface cleaner according to claim 1, further comprising a handle coupled to the center column.

4. The surface cleaner according to claim 3, wherein the handle extends above the supply tank and the recovery tank.

5. A surface cleaner comprising:

a main body having a base that supports the surface cleaner on a surface and a center column extending upwardly from the base;

a supply tank removably coupled to and supported by the base, the supply tank having an upper portion and a lower portion, where the lower portion is positioned to be coupled to the base in an attached position;

a recovery tank removably coupled to and supported by the base, the recovery tank having an upper portion and a lower portion, where the lower portion is positioned to be coupled to the base in an attached position;

a detergent tank removably coupled to and supported by the base, the detergent tank including an upper portion and a lower portion, wherein the lower portion is positioned to be coupled to the base in an attached position, wherein both the supply tank and the recovery tank are substantially U-shaped around the main body and the supply tank, recovery tank and detergent tank together encompass the center column, such that the upper portion of the supply tank, the upper portion of the recovery tank and the upper portion of the detergent tank form an exterior wall the floor cleaner, wherein wherein the upper end of the exterior wall, defined only by the supply tank, recovery tank and detergent tank, extends around the entire perimeter of the surface cleaner with the center column extending upwards into a space between the supply tank, the recovery tank, and the detergent tank.

6. The surface cleaner according to claim 5, wherein the supply tank and the recovery tank are formed from a transparent or translucent material.

7. The surface cleaner according to claim 5, further comprising a handle coupled to the center column.

8. The surface cleaner according to claim 7, wherein the handle extends above the upper portion of the supply tank and the upper portion of the recovery tank.

9. The surface cleaner according to claim 7, wherein the handle extends between the supply tank and the recovery tank.

10. The surface cleaner according to claim 5, wherein the supply tank further includes a tank handle on the upper portion.

11. The surface cleaner according to claim 10, wherein the tank handle is a bail handle.

12. The surface cleaner according to claim 5, further comprising a cleaning tool attached to the main body.

13. The surface cleaner according to claim 5, further comprising a suction source, wherein the suction source is powered by a battery pack.

14. The surface cleaner according to claim 5, wherein the center column includes a protrusion positioned to mate with a groove in the supply tank to guide the supply tank into the attached position.

15. The surface cleaner according to claim 5, wherein the center column includes a groove positioned to mate with a protrusion in the supply tank to guide the supply tank into the attached position.

* * * * *